United States Patent [19]

Bingham

[11] Patent Number: 4,843,995

[45] Date of Patent: Jul. 4, 1989

[54] AUTOMATIC BOAT BOTTOM CLEANER

[75] Inventor: Lowell B. Bingham, West Chester, Pa.

[73] Assignee: Eyvonne M. Bingham, West Chester, Pa.

[21] Appl. No.: 90,258

[22] Filed: Aug. 27, 1987

[51] Int. Cl.[4] ..... B60S 3/00

[52] U.S. Cl. ..... 114/222; 114/51; 15/1.7

[58] Field of Search ..... 114/222, 223, 221 R, 114/44, 50, 51; 15/222, 1.7, 210 R, 209 C, 244 R

[56] References Cited

U.S. PATENT DOCUMENTS

| | | | |
|---|---|---|---|
| 630,260 | 8/1899 | McLane | 114/222 |
| 676,926 | 6/1901 | Stump | 114/222 |
| 2,384,580 | 9/1945 | Wertheimer | 114/51 |
| 3,227,124 | 1/1966 | Campbell | 114/222 |
| 3,395,665 | 8/1968 | Rosenberg | 114/51 |
| 3,561,391 | 2/1971 | Locati | 114/222 |
| 3,709,184 | 1/1973 | Laney | 114/222 |
| 3,844,237 | 10/1974 | Gil | 114/51 |
| 4,280,439 | 7/1981 | Jackson | 114/222 |
| 4,395,966 | 8/1983 | Murphy | 114/222 |
| 4,648,344 | 3/1987 | Burgers | 114/222 |

FOREIGN PATENT DOCUMENTS

| | | | |
|---|---|---|---|
| 16114 | 10/1980 | United Kingdom | 114/222 |

*Primary Examiner*—Joseph F. Peters, Jr.
*Assistant Examiner*—Clifford T. Bartz
*Attorney, Agent, or Firm*—Richard L. Hansen

[57] ABSTRACT

A mechanical device for cleaning the bottom of a boat moored in a body of water includes a line with a central scrubber section, ends affixed above the boat's water line and means for urging the scrubber section upward. Passing the boat over the line forces the scrubber section against the bottom, cleaning it.

16 Claims, 2 Drawing Sheets

(a)

(b)

(a)

(b)

AUTOMATIC BOAT BOTTOM CLEANER

This invention is in the field of boats and ships. More specifically, it relates to implements for cleaning the hulls of such watercraft.

It has been widely known and appreciated for hundreds of years that marine growths and other contaminants clinging to the bottom of a boat impair the boat's performance. Consequently, a number of schemes have been devised over the years to clean the hull of a boat periodically.

These methods include hauling the boat from the water or dry-docking it to provide access with conventional cleaning materials; these techniques are effective, but they are inconvenient at best and can be very expensive if the boat is large. The application of antifouling paint to the bottom is a second method, but it has been found that very poisonous residues enter the water as the paint erodes, causing environmental damage. Mechanically cleaning the bottom of the water-borne boat represents another general technique. It is to this latter type of cleaning method that this invention relates.

Various devices for mechanically cleaning a water-borne boat has been described in the prior art. They typically include various scrapers, brushes and abrasive pads which are dragged across the boat bottom.

Many of these devices employ scrubbing action directed laterally, port-starboard, across the bottom. In this regard, U.S. Pat. No. 630,260; U.S. Pat. No. 676,926; U.S. Pat. No. 4,395,966; and U.S. Pat. No. 4,648,344 are pertinent. In each instance, power must be applied to the device to effect the lateral scrubbing action. In addition, the device must be advanced longitudinally along the bottom to clean it entirely.

Other mechanical cleaning devices operate in a manner very similar to an automatic car wash, having brushes which ride down under the boat and are powered to rotate longitudinally. U.S. Pat. No. 3,227,124 and U.S. Pat. 3,561,391 represent devices of this type.

The failure of known mechanical bottom cleaning devices to satisfy the needs of the market is made evident by the fact they are simply not available in commerce. The known devices are cumbersome, less effective than antifouling paints, and require the application of external power.

Therefore, it is the intent of the instant invention to provide a mechanical device for automatically cleaning the bottom of a boat which overcomes the aforesaid problems. In attaining this overall goal, it is also an objective to provide a device which is simple, uncomplicated and inexpensive. Furthermore, it is an objective to provide a cleaning device which requires the application of no external force, motion of the boat providing the power. An added objective is the provision of an effective method for keeping the bottom of a boat clean without adversely affecting the environment.

In attaining the aforesaid goal and objectives, this invention provides an automatic cleaner for a boat moored in a body of water. The cleaner includes a line having centrally located scrubbing means, along with port and starboard ends. Means are provided to urge the scrubbing means upward against the bottom of the boat as it rides over the line. For example, the ends can be passed through blocks which are affixed above the boat's waterline to structures anchored on the port and starboard sides of the mooring. The ends of the line are attached to weights. When the boat enters or leaves the mooring it forces the line downward against the upward force imparted by the weights. The boat's motion produces a longitudinal scrubbing action without the application of external power.

This invention will be understood more readily by reference to the drawings which accompany this specification and to the detailed description which follows.

Figure 1:
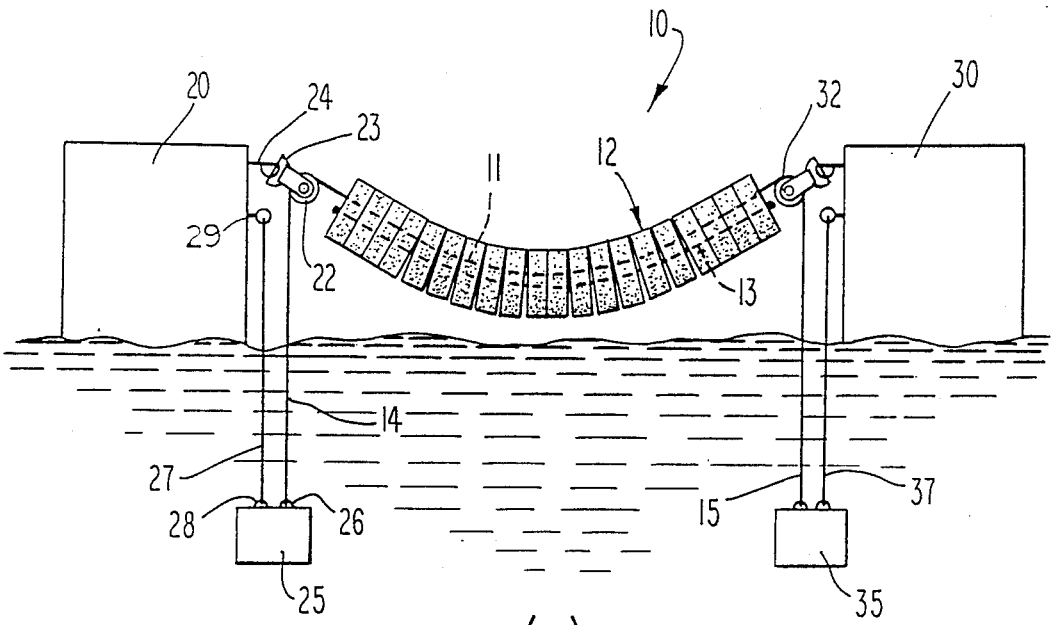
FIG. 1 is an end view which illustrates one embodiment of the cleaner of this invention, containing some optional features.
Figure 1:
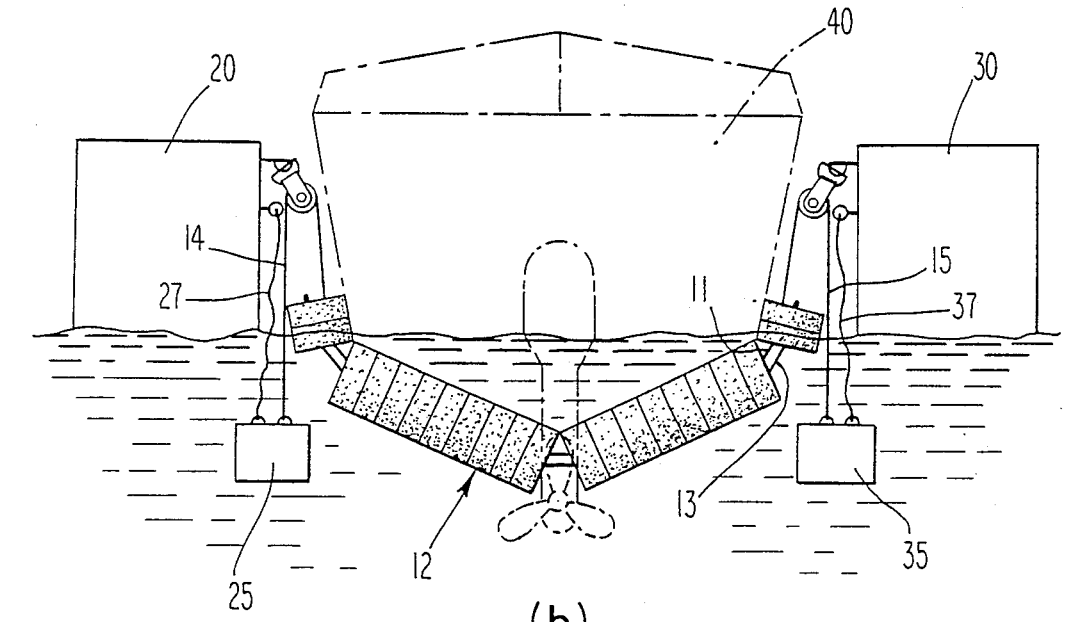

With reference first to FIG. 1(*a*), boat cleaner 10 includes line 11. The central portion of line 11 carries scrubbing means, e.g., pads 12. Means are provided to urge the scrubbing means upward. That is, port and starboard line ends 14 and 15 can be passed through port and starboard blocks 22 and 32, respectively, and ends 14 and 15 attached to weights 25 and 35, respectively. The blocks are attached above the boat's waterline to structures 20 and 30, which are anchored with respect to each other and the waterline on either side of the mooring. For example, shackle 23 and eye bolt 24 can be employed to attach block 22 to structure 20, and end 14 can be attached to weight 25 via eye bolt 26.

If desired, secondary lines 27 and 37 can be employed to attach weights 25 and 35 to structures 20 and 30, respectively. This optional feature permits adjustment of line 11 with respect to the water. Line 27 can be attached with eye bolts 28 and 29 if desired.

Figure 2:
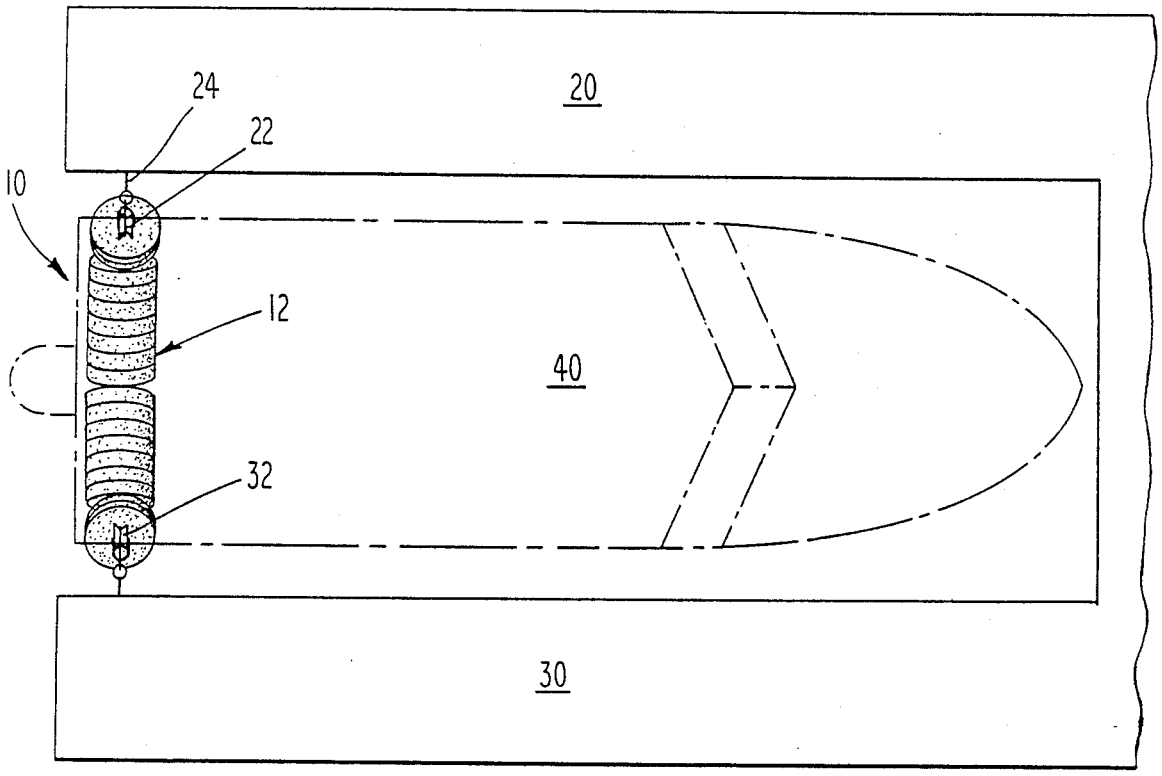
FIG. 2 is a plan view of the cleaner of FIG. 1.

The scrubbing means may include a series of abrasive pads 12 strung on the line as shown in FIG. 1; suitable pads are available in commerce. Such pads may be round when viewed along line 11, as evident in FIG. 2, in which case the pads are preferably strung acentrically with respect to line 11; this discourages free rotation of the pads and enhances the scrubbing action. Alternatively, the pads may have an oval, rectangular or square aspect when viewed along line 11, in order to discourage rotation about the line when the boat bottom is contacted. In addition, the line itself can be braided with integral tuft-like scrubbers, rags can be tied about the line, or a unitary, elongated pad can be strung on the line as scrubbing means if desired. Rotation can also be discouraged by employing a line 11 with a square cross section. It may be advantageous to string a second line 13 through the pads to discourage rotation, as shown in FIGS. 1 and 2. Furthermore, two lines, as 11 and 13, may be employed and the pads strung thereon, but each line can be led through one or both blocks, as 22 and 32, weighted, etc., the tension on the lines discouraging rotation of the pads. Each block will have two sheaves if both lines are led through both blocks.

Means, other than those described above, for urging scrubbing means 12 upward include simply constructing line 11 with an elastic restoring set. For example, line 11 may be elastic "shock cord"; the ends can be attached directly to structures 20 and 30 with eye bolts. Alternatively, line ends 14 and 15 can be led through an additional set of blocks beneath the water and attached to floats in lieu of attachment to weights.

FIG. 1(b) and FIG. 2 illustrate apparatus of this invention in combination with boat 40. It will be noted that each time the boat passes into or out of the mooring, pads 12 scrub the bottom automatically. Furthermore, no power need be applied to the apparatus; the boat's motion supplies the scrubbing action.

Figure 3:
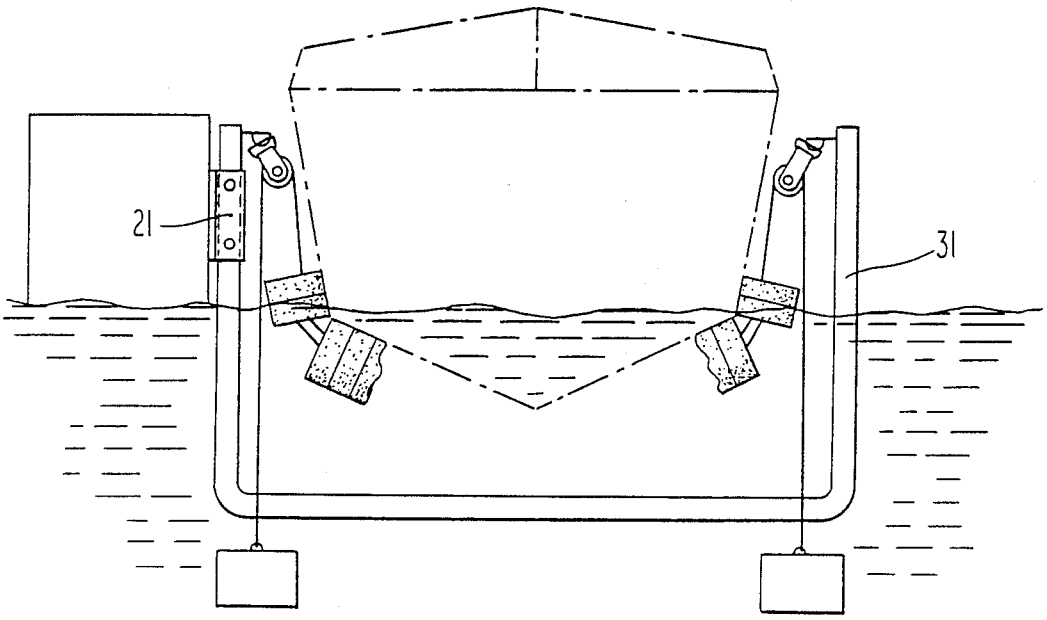
FIG. 3 is an end view illustrating another embodiment of the cleaner of this invention.

The anchored structures on the port and starboard sides of the mooring can be docks 20 and 30, as illustrated in FIGS. 1 and 2. On the other hand, either or both of the structures can be posts, pilings, buoys, or standards of various types. FIG. 3 illustrates an embodiment of the invention in which standard 31 is attached to a dock using bracket 21.

It will be evident that there are a number of variations of the automatic boat bottom cleaner of this invention which are not specifically described or illustrated above. To the extent the following claims embrace such variations, they are within the scope of this invention.

What is claimed is:

1. An automatic bottom cleaner for a boat moored at a mooring in a body of water comprising a line having port and starboard ends;

scrubbing means located along said line between said ends;

anchored structures on the port and starboard sides of the mooring;

a pair of blocks affixed to said structures above the water to pass said ends; and a pair of weights attached to said ends for urging said scrubbing means upward;

whereby passing the boat over said line upon entering or leaving the mooring depresses said line which then passes under the boat and scrubs the bottom of the boat.

2. The apparatus of claim 1 wherein at least one of said anchored structures is a standard affixed to a dock element.

3. The apparatus of claim 1 wherein said scrubbing means includes a series of abrasive pads strung on said line.

4. The apparatus of claim 3 wherein said line passes acentrically through said pads.

5. The apparatus of claim 3 further comprising a second line passed through said series of pads.

6. The apparatus of claim 1 further comprising secondary lines attaching said weights directly to said anchored structures.

7. The apparatus of claim 1 wherein at least one of said anchored structures is a boat dock element.

8. A method for cleaning the bottom of a boat moored at a mooring in a body of water which comprises providing apparatus which includes a line having port and starboard ends; scrubbing means located along said line between said ends; anchored structures on the port and starboard sides of the mooring; a pair of blocks affixed to said structures above the water to pass said ends; and a pair of weights attached to said ends for urging said scrubbing means upward; and passing the boat over said line.

9. The method of claim 8 wherein at least one of said anchored structures is a boat dock element.

10. The method of claim 8 wherein at least one of said anchored structures is a standard affixed to a dock element.

11. The method of claim 8 wherein said scrubbing means includes a series of abrasive pads strung on said line.

12. The method of claim 11 wherein said line passes acentrically through said pads.

13. The method of claim 11 further comprising a second line passed through said series of pads.

14. The method of claim 8 further comprising secondary lines attaching said weights directly to said anchored structures.

15. An automatic bottom cleaner for a boat moored at a mooring in a body of water comprising a line having port and starboard ends;

scrubbing means which includes a series of abrasive pads strung on and located along said line between said ends, with a second line passed through said series of pads;

anchored structures on the port and starboard sides of the mooring to support said ends above the water; and means for urging said scrubbing means upward;

whereby passing the boat over said line upon entering or leaving the mooring depresses said line which passes under the boat and scrubs the bottom of the boat.

16. A method for cleaning the bottom of a boat moored at a mooring in a body of water which comprises providing apparatus which includes a line having port and starboard ends; scrubbing means which includes a series of abrasive pads strung on and located along said line beween said ends, with a second line passed through said series of pads; anchored structures on the port and starboard sides of the mooring to support said ends above the water; and means for urging said scrubbing means upward; and passing the boat over said line.

* * * * *